US009162090B2

(12) United States Patent
Theisen et al.

(10) Patent No.: US 9,162,090 B2
(45) **Date of Patent: *Oct. 20, 2015**

(54) LUMBAR WEAR-PAD

(71) Applicant: Honeywell International Inc., Morristown, NJ (US)

(72) Inventors: Gina Marie Theisen, Blaine, MN (US); Dennis Collins, Blaine, MN (US); Robert Luckey, Blaine, MN (US)

(73) Assignee: Honeywell International Inc., Morristown, NJ (US)

( * ) Notice: Subject to any disclaimer, the term of this patent is extended or adjusted under 35 U.S.C. 154(b) by 67 days.

This patent is subject to a terminal disclaimer.

(21) Appl. No.: 13/957,243

(22) Filed: Aug. 1, 2013

(65) Prior Publication Data

US 2015/0034416 A1 Feb. 5, 2015

(51) Int. Cl.
*A62B 35/00* (2006.01)

(52) U.S. Cl.
CPC ..... *A62B 35/0031* (2013.01); *A62B 35/0025* (2013.01)

(58) Field of Classification Search
CPC ..... A41D 13/015; A41D 13/05
USPC ..... 182/3; 2/467
See application file for complete search history.

(56) References Cited

U.S. PATENT DOCUMENTS 5,086,514 A * 2/1992 Ross ..... 2/467
5,127,610 A 7/1992 Provasoli
5,129,101 A 7/1992 Douglas
5,140,995 A * 8/1992 Uhl ..... 128/846
5,207,635 A * 5/1993 Richards et al. ..... 602/19
5,387,183 A * 2/1995 Jones ..... 602/19
6,068,606 A * 5/2000 Castel et al. ..... 602/19
6,117,096 A * 9/2000 Hassard ..... 602/19
6,305,031 B1 * 10/2001 White ..... 2/455
6,328,192 B1 12/2001 Sundara et al.
8,205,273 B2 * 6/2012 Kataoka ..... 2/456
8,276,217 B1 10/2012 Hamilton
8,281,419 B2 10/2012 Rietdyk et al.
8,333,262 B1 * 12/2012 Carpenter et al. ..... 182/6
2002/0046903 A1 * 4/2002 Strickler ..... 182/36
2004/0031083 A1 2/2004 Copp
2004/0242094 A1 12/2004 Copp
2005/0035170 A1 * 2/2005 Sears et al. ..... 224/630
2005/0067221 A1 3/2005 Wolner et al.
2008/0092281 A1 4/2008 Morrow et al.

(Continued)

*Primary Examiner* — Charles A Fox
*Assistant Examiner* — Kristine Florio
(74) *Attorney, Agent, or Firm* — Craige Thompson; Thompson Patent Law

(57) ABSTRACT

Apparatus and associated methods relate to a flexible lumbar wear-pad having an external low-friction high-wear-resistance surface, the lumbar wear-pad configured to be replaceably coupled to the lower back region of a belted fall-protection safety harness. In various embodiments, the lumbar wear-pad may cover a length of the webbing over the hip and lumbar vertebrae regions of a wearer's lower back. In some embodiments a lumbar wear-pad may be field replaceable on a fall-protection safety harness. An exemplary embodiment may have three prominences, a smaller center prominence located near a wearer's lumbar vertebrae and two side prominences located near a wearer's hip bones. In some embodiments, the lumbar wear-pad may be flexible so as to anatomically conform to a wearer's body. Exemplary lumbar wear-pads may provide protection for both a wearer and the wearer's harness during sliding or leaning engagements with vertical surfaces.

16 Claims, 18 Drawing Sheets

(56) References Cited

U.S. PATENT DOCUMENTS

2011/0307999 A1* 12/2011 Jourde et al. ..... 2/462
2012/0017406 A1* 1/2012 Colorado ..... 24/593.1
2015/0033458 A1* 2/2015 Theisen et al. ..... 2/467

* cited by examiner

LUMBAR WEAR-PAD

CROSS-REFERENCE TO RELATED APPLICATIONS

This application fully incorporates the disclosures of the following previously submitted applications by reference herein:

| | | |
|---|---|---|
| 61/694,759 | Fall Protection Harness Assembly | Aug. 29, 2012 |
| 61/712,243 | Fall Protection Harness Assembly | Oct. 10, 2012 |
| 13/892,127 | A Self-Retracting Lifeline Connecting System | May 10, 2013 |
| 12/659,885 | D-Ring with Rescue Attachment and Lanyard Attachments Integrated | Sep. 5, 2012 |

TECHNICAL FIELD

Various embodiments relate generally to fall-protection safety equipment, and more specifically to fall-protection harnesses.

BACKGROUND

Fall-protection safety harnesses are widely used in various industries and recreational activities. Many traditional industries such as building construction and bridge maintenance require workers to work at high elevations. Such industries have long used various fall-protection equipment to provide for safe work environments. New industries too use various fall-protection equipment to provide safety to their workers. One such quickly growing industry is the wind energy industry. Wind turbines provide a growing percentage of energy used in the United States and in the world. These wind turbines are located at the top of tall towers. When a wind-turbine tower is being erected or when a wind turbine needs maintenance, workers must ascend these towers. These towers typically present a narrow profile so as not to block the wind incident upon the blades of the turbine. These narrow profile towers have confined space within. The worker access to a turbine may require a worker to enter the base of the tower and then to ascend a vertical ladder located near the inside wall of the tower. As the worker ascends or descends the ladder the worker may be very near the tower walls due to the confined space. Some towers may present such a confined space that workers may be pressed against the tower walls while ascending, descending or working on a task.

SUMMARY

Apparatus and associated methods relate to a flexible lumbar wear-pad having an external low-friction high-wear-resistance surface, the lumbar wear-pad configured to be replaceably coupled to the lower back region of a belted fall-protection safety harness. In various embodiments, the lumbar wear-pad may cover a length of the webbing over the hip and lumbar vertebrae regions of a wearer's lower back. In some embodiments a lumbar wear-pad may be field replaceable on a fall-protection safety harness. An exemplary embodiment may have three prominences, a smaller center prominence located near a wearer's lumbar vertebrae and two side prominences located near a wearer's hip bones. In some embodiments, the lumbar wear-pad may be flexible so as to anatomically conform to a wearer's body. Exemplary lumbar wear-pads may advantageously protect both a wearer and the wearer's harness during sliding or leaning engagements with vertical surfaces.

Some apparatus and associated methods may also further relate to a dorsal wear-pad having an external, low-friction, high-wear-resistance surface, the dorsal wear-pad configured to be releasably coupled to a D-ring connection region of a fall-protection safety harness. In various embodiments, the dorsal wear-pad may project out and away from a wearer so as to prevent the D-ring from contacting a wall surface. For example, the dorsal wear-pad may have a D-ring aperture through which the D-ring may project. In some embodiments, the dorsal wear-pad may have a back shield to prevent a snap-hook connected to the D-ring from contacting a wearer's back. An exemplary embodiment may have two prominences, one on either side of the D-ring. Some exemplary dorsal wear-pads may advantageously protect both a wearer and the wearer's harness during sliding or leaning engagements with vertical surfaces.

Various embodiments may achieve one or more advantages. For example, some embodiments may provide slidability to a wearer when ascending or descending narrow vertical structures, such as for example, wind-turbine towers. In some embodiments, the rounded prominences may facilitate sliding while ascending or descending next to a vertical surface. In an exemplary embodiment, the vertical surface may be protected from damage during the sliding event due to a pliable material of the exemplary apparatus. In some embodiments, a flexible material may be used to facilitate comfort by permitting the device to anatomically conform to a wearer's body. In some embodiments, a rounded prominence may permit a wearer to rock comfortably while leaning against a vertical wall. Such rounded prominences may thereby facilitate the wearer to adopt an optimal position for performing the wearer's task, while in a circumferentially confined elevated environment.

In various embodiments, the wear-pad may prevent the abrasion of a safety harness. Such prevention may extend the usable life of the safety harness. This harness life extension may lower the cost of doing business in arenas that require their use. In some embodiments the cost of a wear-pad may be low in comparison to the cost of replacing a safety harness. In some embodiments, a releasable wear-pad may permit a wearer to remove the wear-pad when not needed. By permitting the removal of a wear-pad, optimal comfort may be promoted. By permitting the removal of a wear-pad, a wearer may be better able to navigate in close quarters when not sliding against a wall, for example. In some embodiments, the wear-pad may protect the wall paint of a surface against which a wearer may slide. Such wall protection may reduce maintenance costs of repainting. Protecting wall paint may prevent oxidation of the uncovered metal surface, for example. Such oxidation reduction may increase the structural safety of the wind turbine, for example. In some embodiments, the wearer may prevent injury when sliding past welded joints in a wind turbine wall, for example. Using a wear-pad to slide up and down a wall may permit a wearer to ascend or descend more quickly. The ability to ascend or descend quickly may reduce the time needed to perform one's task which may reduce the cost of doing such jobs.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, an exemplary field application of exemplary safety harness wear-pads is briefly introduced with reference to FIG. 1. Second, with reference to FIGS. 2-4C, the discussion turns to exemplary embodiments of lumbar wear-pads which illustrate different physical configurations. Specifically, various advantages and benefits of the various configurations will be discussed. Then, with reference to FIGS. 5-8C, discussion turns to exemplary embodiments of dorsal wear-pads to illustrate different physical configurations. Again, various advantages and benefits of the various configurations will be discussed as components of a fall-protection system.

Figure 1:
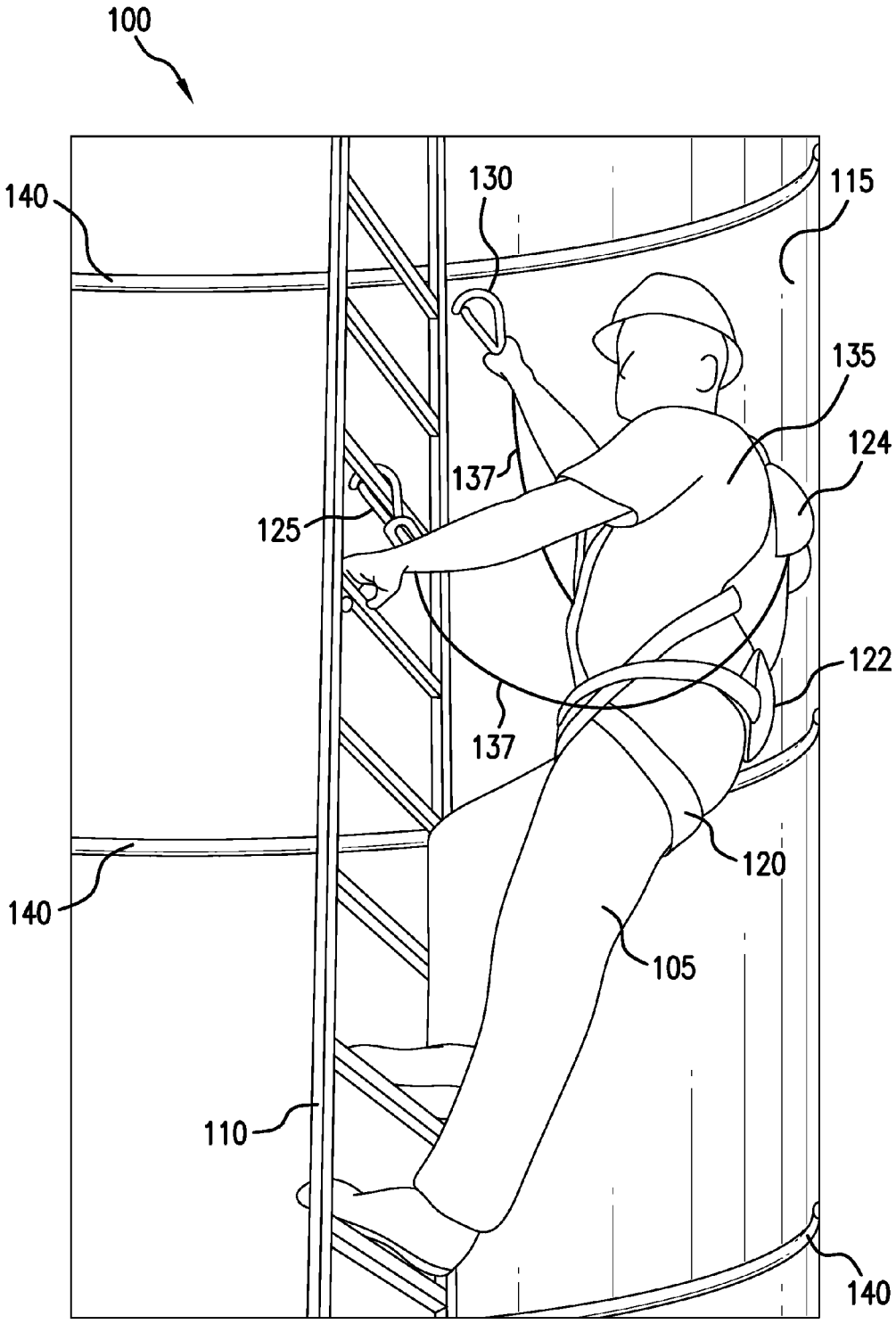
FIG. 1 depicts an exemplary field application of a lumbar wear-pad and dorsal wear-pad in a wind-turbine tower.

FIG. 1 depicts an exemplary field application of a lumbar wear-pad and a dorsal wear-pad in a wind-turbine tower. This figure depicts and exemplary wind-turbine tower scenario 100. In this exemplary scenario 100, a worker 105 is climbing a ladder 110 which is attached the interior wall 115 of the wind-turbine tower. The worker 105, while climbing the ladder 110 is in close proximity to the wall 115. The worker 105 is wearing an exemplary fall-protection safety harness 120 so as to provide a measure of protection in the event of an accidental fall. While the worker 105 ascends, a worker's back 135 may rub against the wall 115 of the wind-turbine tower. If the worker's back 135 rubs against the wall 115, the worker 105 may experience discomfort. The wall 115 is depicted with welded seams 140 which may be painful if the worker 105 is pressed against the wall 115 while ascending or descending quickly. The wall 115 may also have other projecting objects such as bolt heads which may injure a worker, for example. The wall 115 may be painted, and the paint may be scratched by a D-ring (not visible in this figure) connected to the fall-protection safety harness 120 as the worker 105 ascends and descends while pressed against the wall 115. When the paint is scratched, the underlying metal may be exposed to water and oxygen which may cause the structural integrity of the tower to be compromised. But in this figure, the fall-protection safety harness 120 is depicted including an exemplary lumbar wear-pad 122 and an exemplary dorsal wear-pad 124. As the worker 105 ascends, the lumbar wear-pad 122 and/or the dorsal wear-pad 124 may slidably engage the wall 115 of the wind-turbine tower.

The worker 105 is shown holding a locking rebar hook 125, 130 in each hand. The worker 105 is shown attaching a locking rebar hook 125 to the ladder as he ascends. As the worker 105 ascends the ladder 110, the worker 105 first may attach one of the locking rebar hooks 125 to the ladder 110. Then, as the worker 105 ascends a bit further, the worker 105 may attach the other locking rebar hook 130 to the ladder 120. The worker 105 may then detach the first locking rebar hook 125 so that the worker 105 may continue ascending the ladder 110. These locking rebar hooks 125, 130 are each connected to a lanyard 137, which in turn connects to the D-ring of the fall-protection safety harness 120.

Other problems may arise from ascending or descending the ladder 110 while being pressed against the wall 115. For example, the fall-protection safety harness 120 may be chafed as the worker 105 slides against the wall 115. This chafing may abrade a webbing of the safety harness 120. If the webbing of the safety harness becomes abraded, the integrity of the safety harness 120 may be compromised. The worker 105 may also have to perform a difficult task which may require the worker 105 to operate in a contorted position. The worker may have to rock against the wall to change position as he works, for example. Rocking while pressed against a hard surface such as the wall 115 may be uncomfortable for the worker 105. The depicted exemplary lumbar wear-pad 122 may have curved projections which may facilitate such rocking activities.

Figure 2:
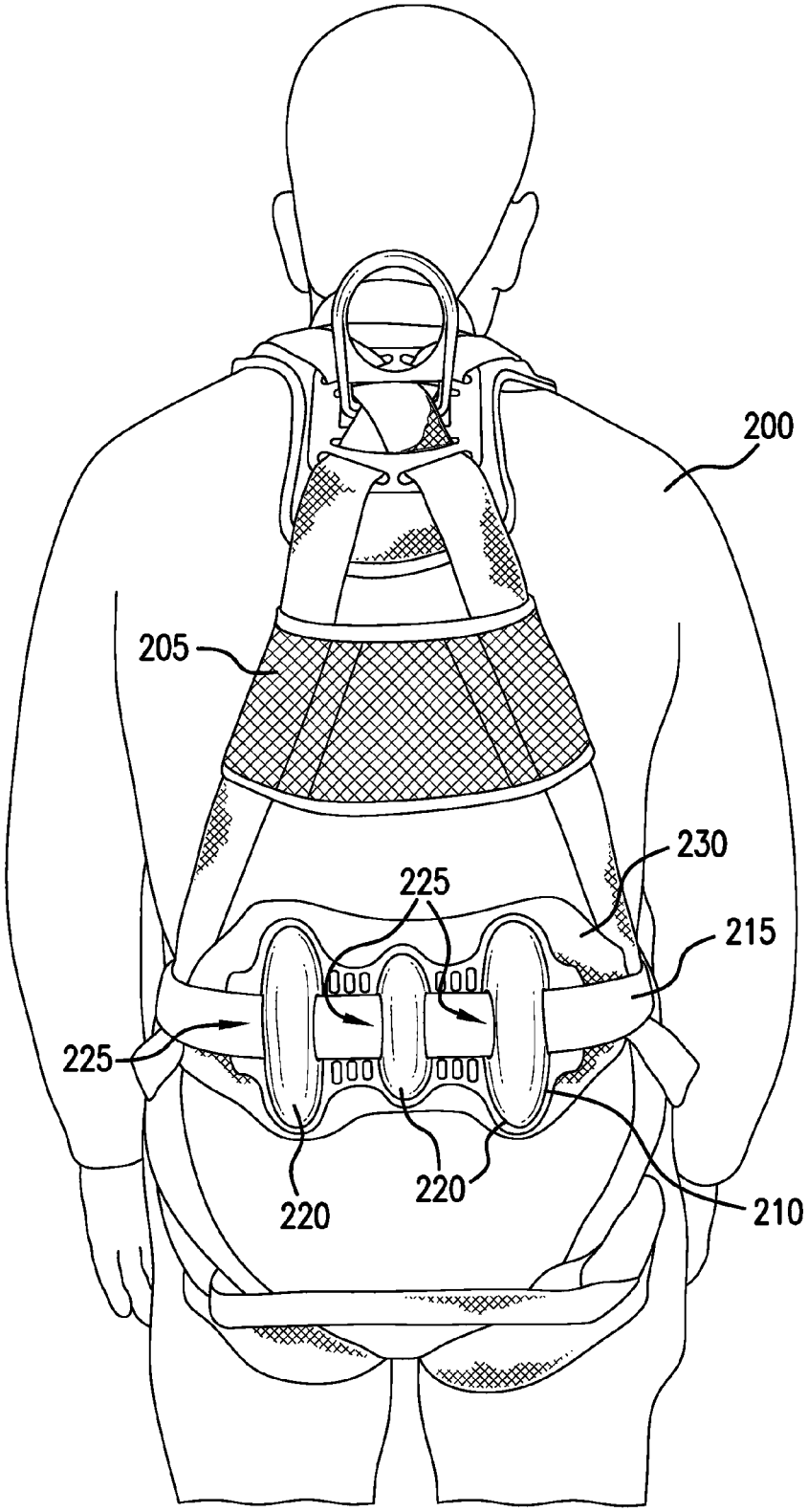
FIG. 2 depicts an exemplary fall-protection safety harness being worn by a wearer, the safety harness including an exemplary lumbar wear-pad.

FIG. 2 depicts an exemplary fall-protection safety harness being worn by a wearer, the safety harness including an exemplary lumbar wear-pad. In this figure, a wearer 200 is wearing an exemplary fall-protection safety harness 205. The safety harness 205 includes an exemplary lumbar wear-pad 210. The lumbar wear-pad 210 may have a low-friction surface which may facilitate sliding against a hard wall. The lumbar wear-pad 210 may be made of a high-wear-resistance material which may permit a long usable lifetime. The lumbar wear-pad 210 shown to be attached to the fall-protection safety harness 205 by a belt 215. The lumbar wear-pad 210 is depicted as having three semi-ellipsoidal projections 220. The semi-ellipsoidal projections 220 are depicted as being located proximate to the hip bones and the lumbar vertebrae of the wearer 200. The lumbar wear-pad 210 may improve comfort by being located proximate these pressure points. Each semi-ellipsoidal projection 220 has a belt aperture 225 through which the belt 215 retains the lumbar wear-pad 210. The lumbar wear-pad 210 is shown located upon an exemplary lumbar comfort pad 230. The lumbar comfort pad 230 may be made of a soft material. The lumbar comfort 230 pad may be made of a breathable material to facilitate cooling for the wearer. Exemplary lumbar comfort pads are described, for example, with reference to at least FIGS. 2-4 in U.S. patent application 61/694,759 titled "Fall Protection Harness Assembly," filed on Aug. 29, 2012, the entire disclosure of which is herein incorporated by reference.

Figure 3A:
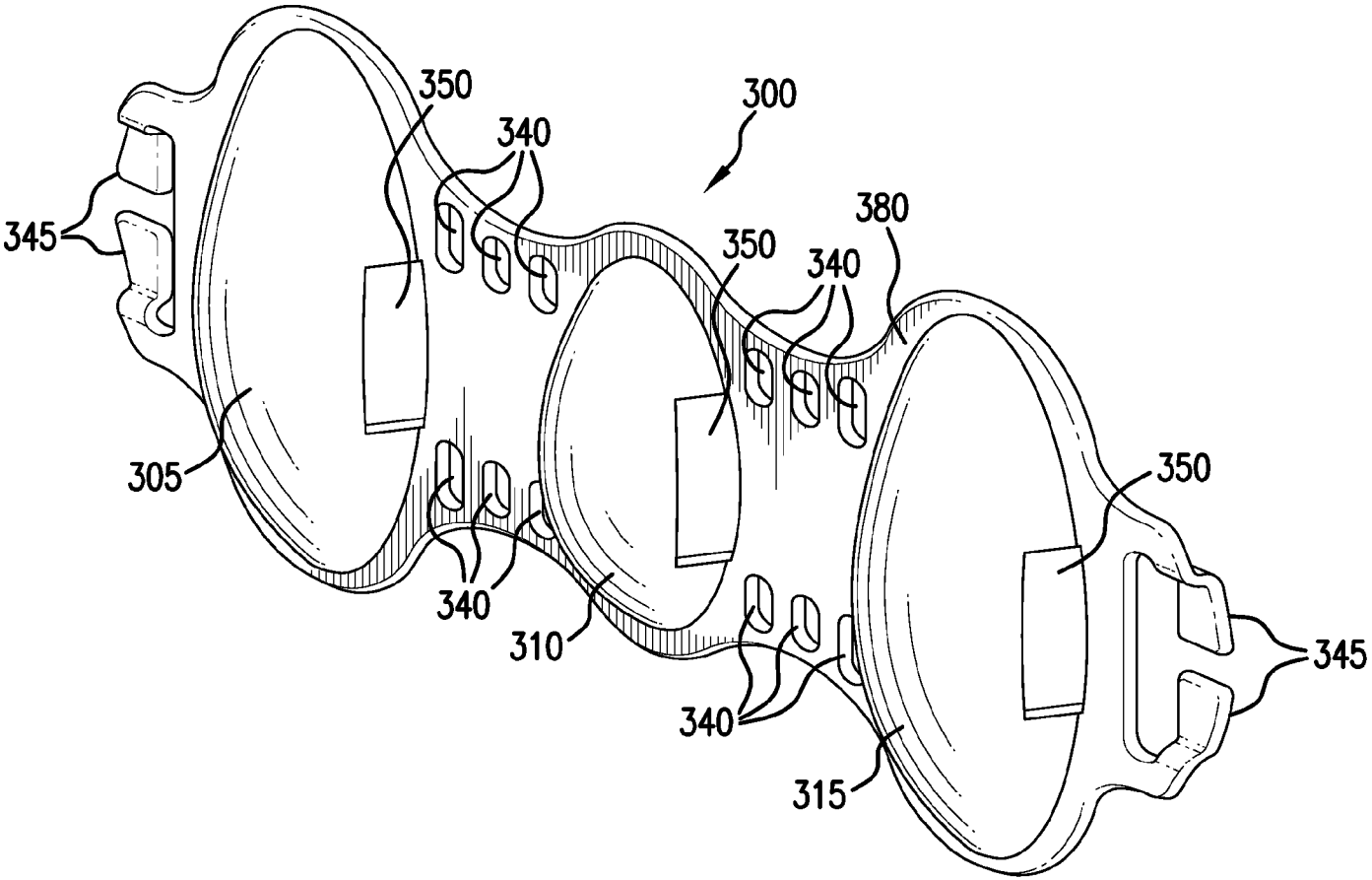
FIGS. 3A-3C depict a perspective view, a plan view and a side elevation view of an exemplary lumbar wear-pad, respectively.
Figure 3B:
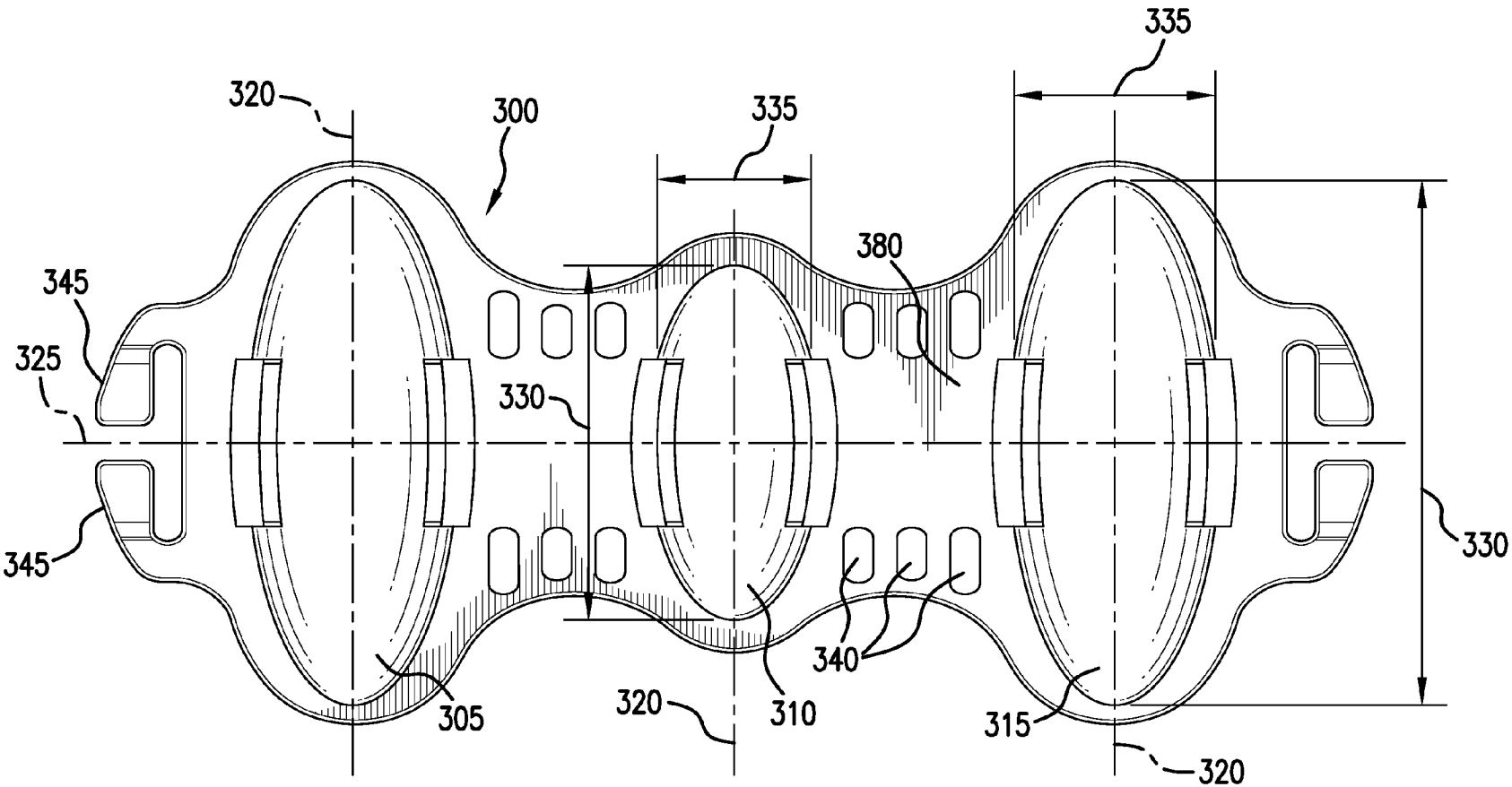
Figure 3C:
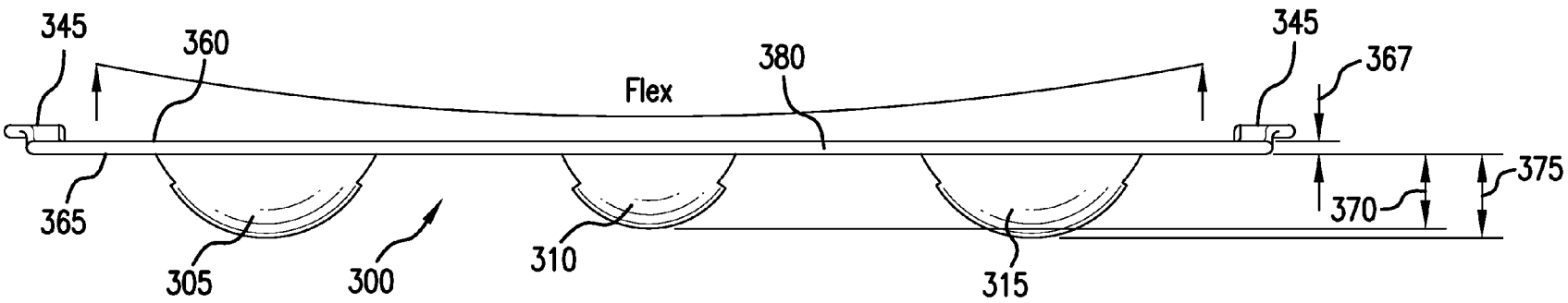

FIGS. 3A-3C depict a perspective view, a plan view and a side elevation view of an exemplary lumbar wear-pad, respectively. In the FIGS. 3A-3C embodiment, an exemplary lumbar wear-pad 300 includes three semi-ellipsoidal projections 305, 310, 315. Semi-ellipsoidal projections may have curvature along both a vertical major axis 320 and along a horizontal minor axis 325. The middle projection 310 is depicted as being smaller than both of the outside projections 305, 310. The middle projection 310 is depicted as having a smaller major dimension 330 and a smaller minor dimension 335 than either of the two outside projections' major and minor dimensions respectively. In FIGS. 3A-3B, various exemplary cooling apertures 340 are depicted. These cooling apertures may operate in conjunction with the breathable lumbar comfort pad 230 to facilitate breathability and/or comfort for the wearer. In this embodiment, webbing harness attachment clips 345 are depicted. These clips may be used to attach the lumbar wear-pad 300 to a webbing which may be distinct from the belt 215 depicted in FIG. 2. Other methods of attachment may be used in other embodiments. For example, the lumbar wear-pad may be riveted to a fall-protection safety harness. Three belt apertures 350 are depicted, one through each of the three projections 305, 310, 315. Each of the belt apertures 350 are aligned on a common axis 325 so as to permit a belt to be received by all three of the belt apertures 350 with requiring the belt to twist or bend.

FIG. 3C depicts a side elevation view of the exemplary lumbar wear-pad 300. The lumbar wear-pad 300 is depicted as having an inwardly-facing surface 360 which inwardly faces the user when worn. The lumbar wear-pad 300 also has an outwardly-facing surface 365 which outwardly faces away from the user when worn. A thickness 367 is defined as the distance between the inwardly-facing surface 360 and the outwardly-facing surface 365. The projections 305, 310, 315 each have an elevation 370, 375 with respect to the outwardly-facing surface 365. The middle projection 310 has an elevation 370 which is smaller than the elevation 375 of the outer projections 305, 315. The depicted lumbar wear-pad 300 also has a substantially-planar base 380. The lumbar wear-pad 300 may be flexible so as to permit anatomical conformation with a wearer's body. An exemplary curvature 385 of the substantially-planar base 380 is depicted.

Figure 4A:
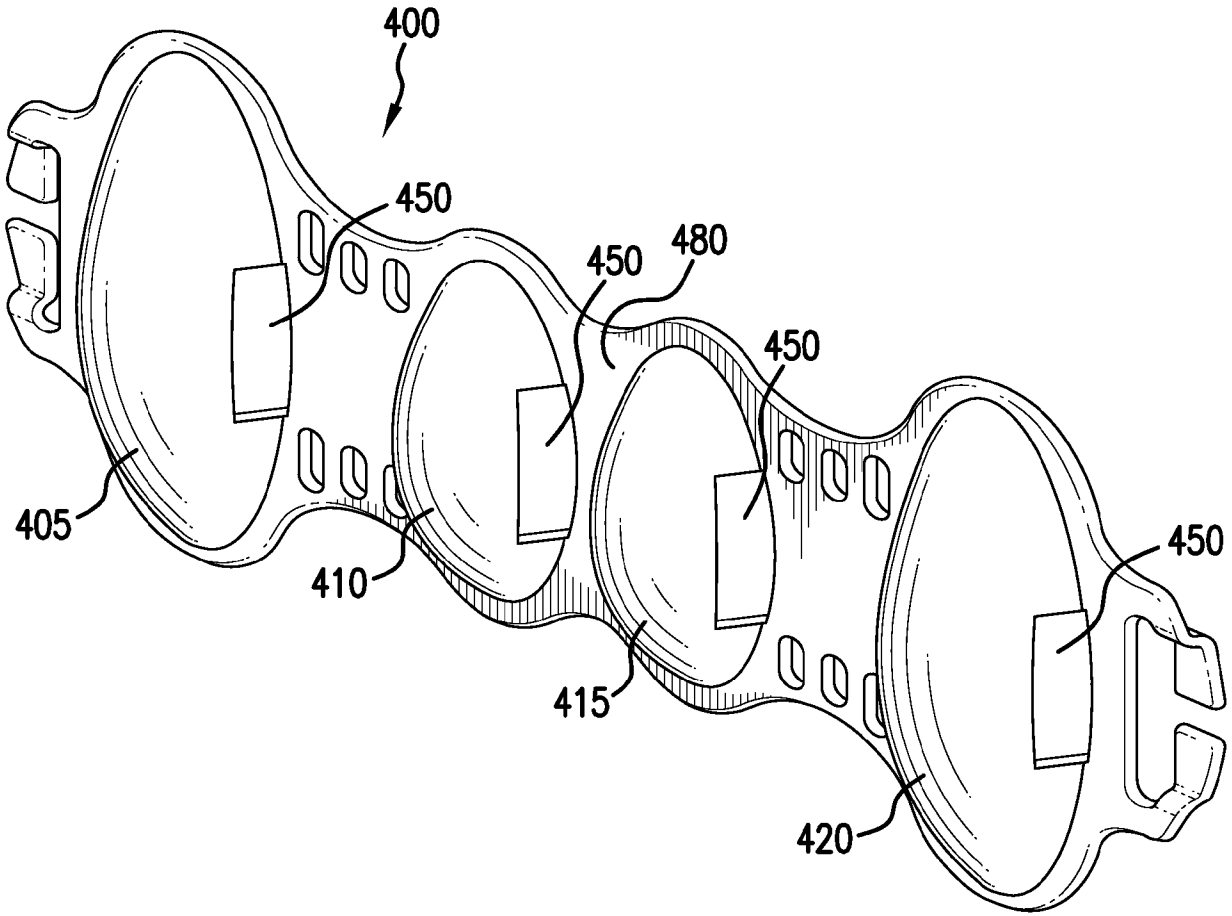
FIGS. 4A-4C depict a perspective view, a plan view and a side elevation view of an exemplary lumbar wear-pad, respectively.
Figure 4B:
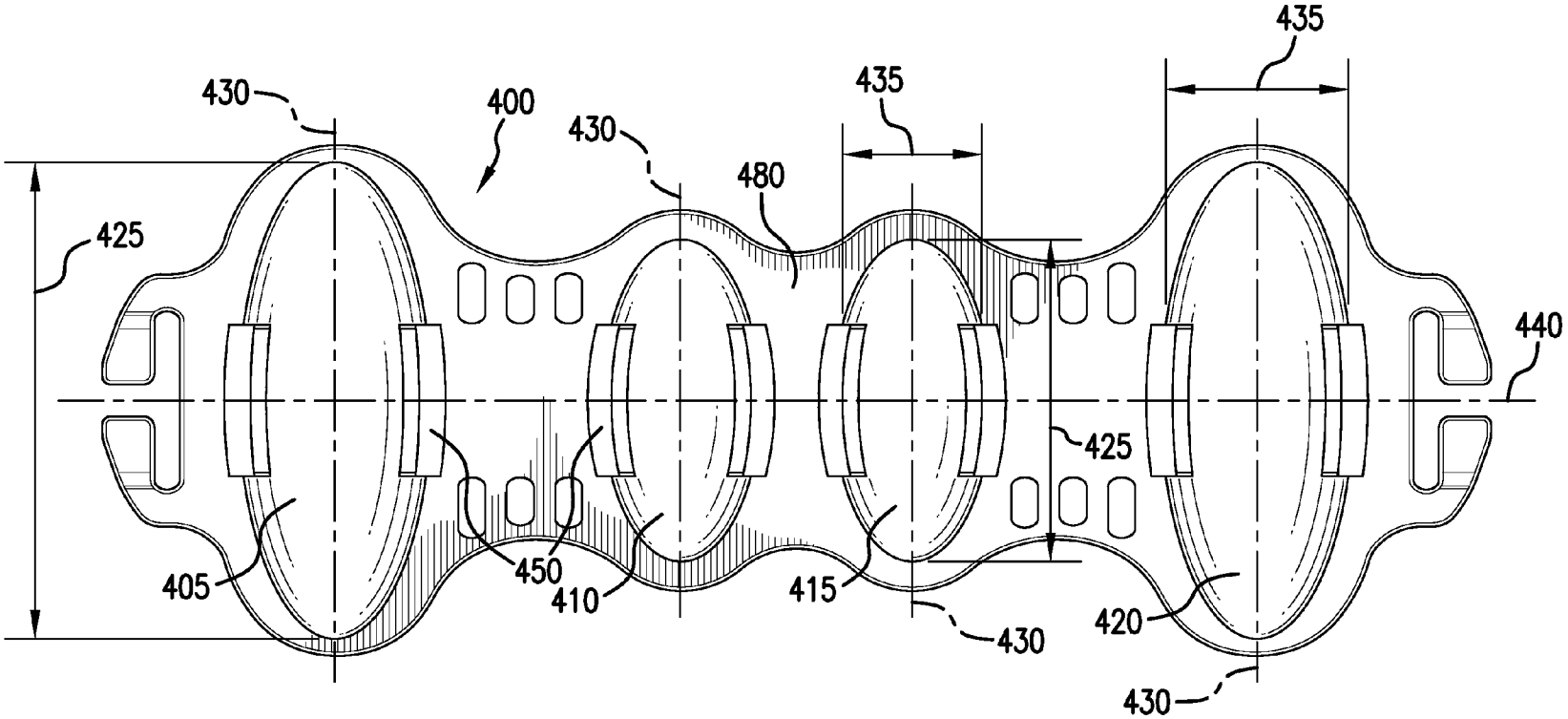
Figure 4C:
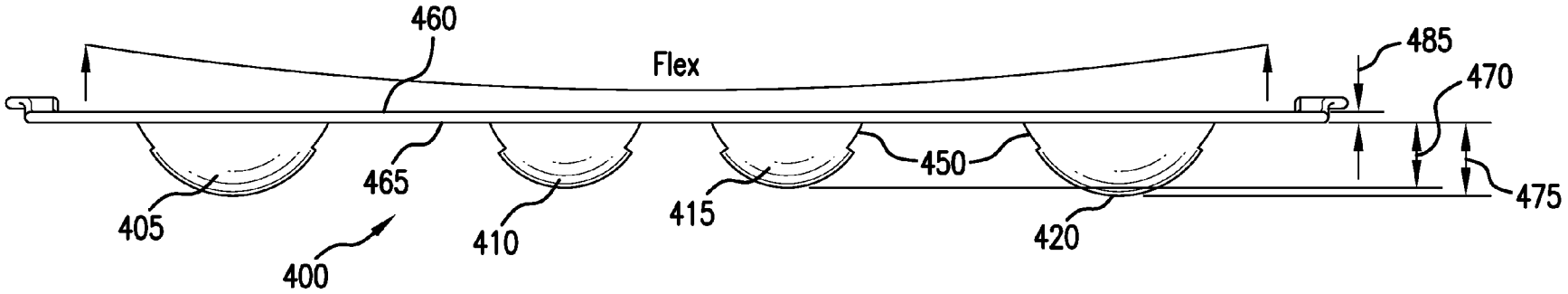

FIGS. 4A-4C depict a perspective view, a plan view and a side elevation view of an exemplary lumbar wear-pad, respectively. In the FIGS. 4A-4C embodiment, a lumbar wear-pad 400 has four exemplary wear-bumps 405, 410, 415, 420. The two outside wear-bumps 405, 420 are larger than the two inside wear-bumps 410, 415. Similar to the FIGS. 3A-3C embodiment, each wear-bump 405, 410, 415, 420 has a major dimension 425 along a vertical major axis 430 and a minor dimension 435 along a horizontal minor axis 440. The major dimension of each wear-bump is significantly greater than its corresponding minor dimension. In this embodiment the minor axes 440 of each wear-bump are aligned on a centerline. The centerline 440, in this embodiment, also bisects each of the belt apertures 450. FIG. 4C depicts a side elevation perspective of the exemplary lumbar wear-pad 400. Again, in this embodiment, the lumbar wear-pad has an inwardly-facing surface 460 of a substantially-planar base 480; the inwardly-facing surface inwardly faces the user when worn. And again, the lumbar wear-pad 400 also has an outwardly-facing surface 465 which outwardly faces away from the user when worn. And again, in this embodiment, the substantially-planar base 480 has a thickness 485. The projections 405, 410, 415, 420 each have an elevation 470, 475 with respect to the outwardly-facing surface 465. The middle projections 410, 415 have an elevation 470 which is smaller than the elevation 475 of the outer projections 405, 420.

Figure 5:
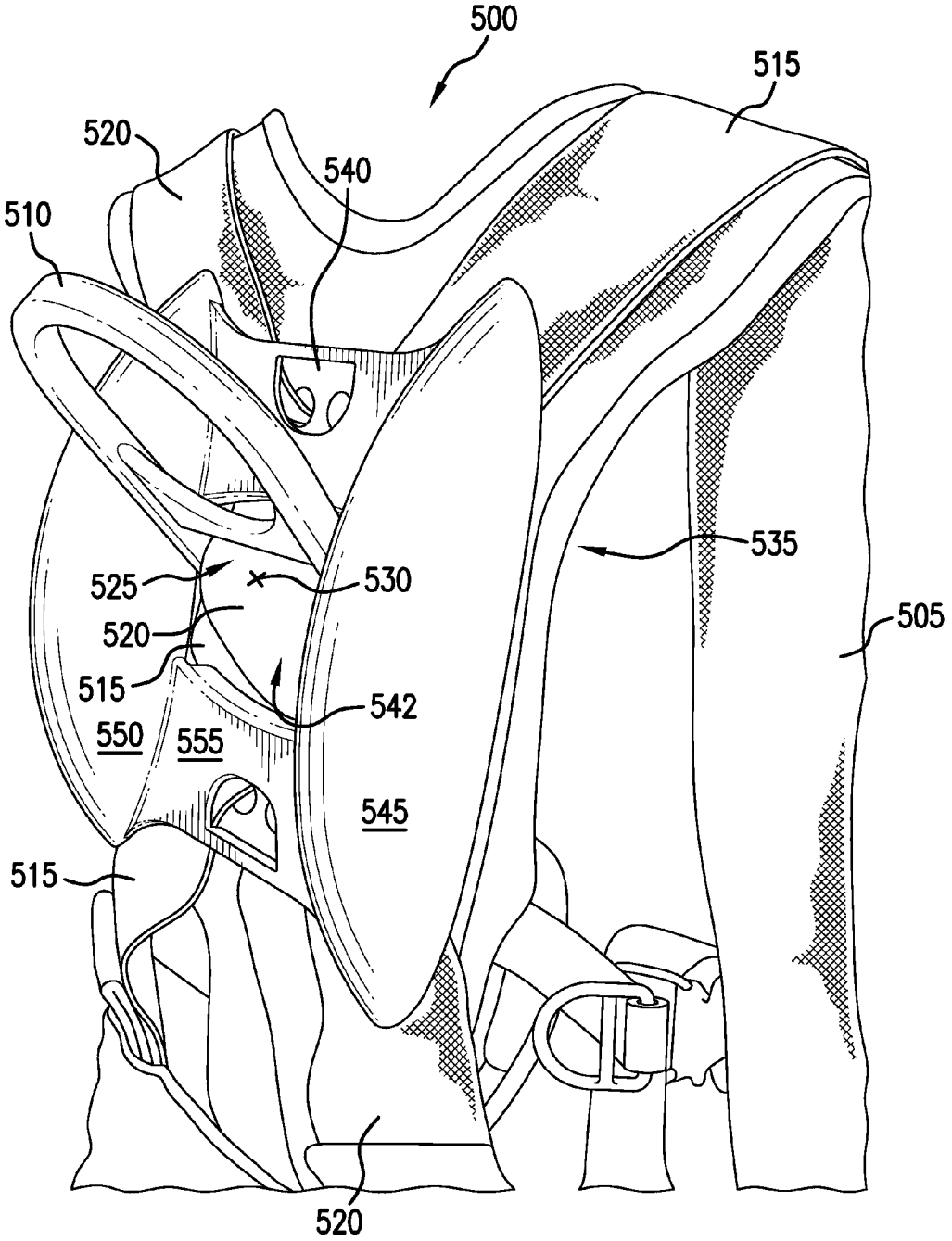
FIG. 5 depicts an exemplary fall-protection safety harness including an exemplary dorsal wear-pad.

FIG. 5 depicts an exemplary fall-protection safety harness including an exemplary dorsal wear-pad. In the FIG. 5 embodiment, a fall-protection safety harness 500 includes a webbing 505 attached to a D-ring 510. D-ring 510 has two lengths 515, 520 of webbing 505 captured in its webbing aperture 525. The two lengths 515, 520 criss-cross at a location 530 approximately coincident with the webbing aperture 525 of the D-ring 510. A dorsal wear-pad 535 is connected to a D-pad 540 which provides webbing apertures through which the webbing may be routed. Exemplary D-pads are described, for example, with reference to at least FIGS. 4A-4B in U.S. patent application Ser. No. 13/892,127 titled "A Self-Retracting Lifeline Connecting System," filed on May 10, 2013, the entire disclosure of which is herein incorporated by reference. The dorsal wear-pad 535 has a D-ring aperture 542 through which the D-ring 510 projects. In this embodiment, the dorsal wear-pad has two wear-bumps 545, 550 projecting from a substantially-planar substrate 555. The D-ring 510 is depicted in an upward-canted position. The D-ring 510 may rotate to a downward-canted position when laden with a load, such as for example, when a snap-hook is attached. The dorsal pad 535 may be configured to permit the D-ring 510 to pivot freely between the upward-canted and the downward-canted positions. A snap-hook, for example, may fasten one or more lanyards to the D-ring 510. In some embodiments, a carabiner may connect to the D-ring 510. The D-ring 510 may also be used by a rescue hook, for example. The weight of a snap-hook and the attached lanyards may provide the force necessary to rotate the D-ring 510 to a downward-canted position. When in the downward-canted position, the D-ring 510 may have a projecting elevation relative to the substantially-planar substrate 555.

Figure 6A:
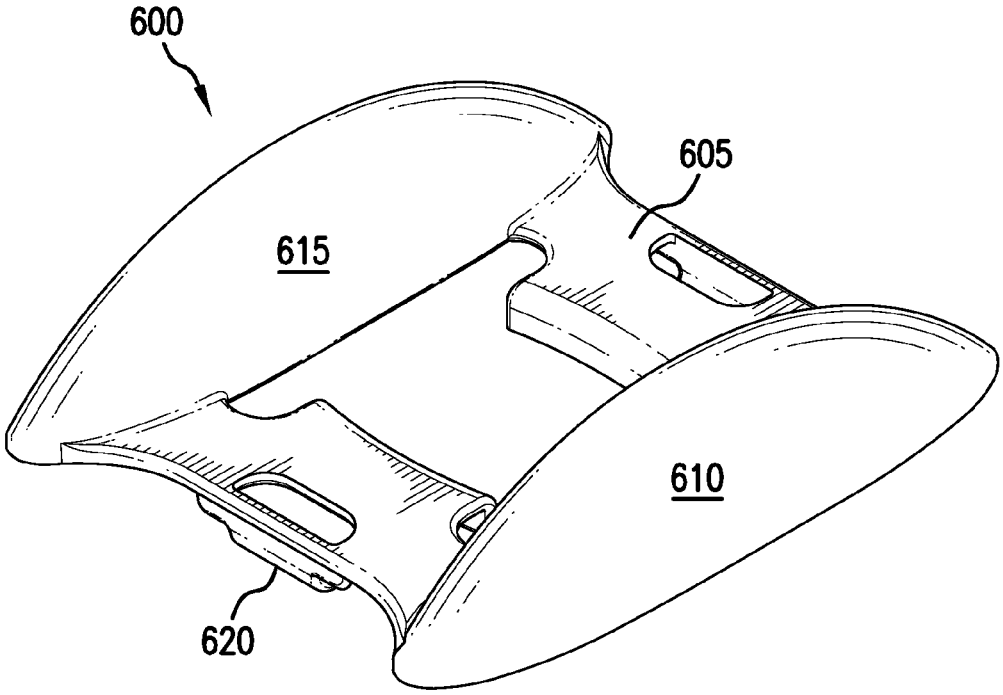
FIGS. 6A-6C depict a perspective view, a side elevation view and a plan view of an exemplary dorsal wear-pad, respectively.
Figure 6B:
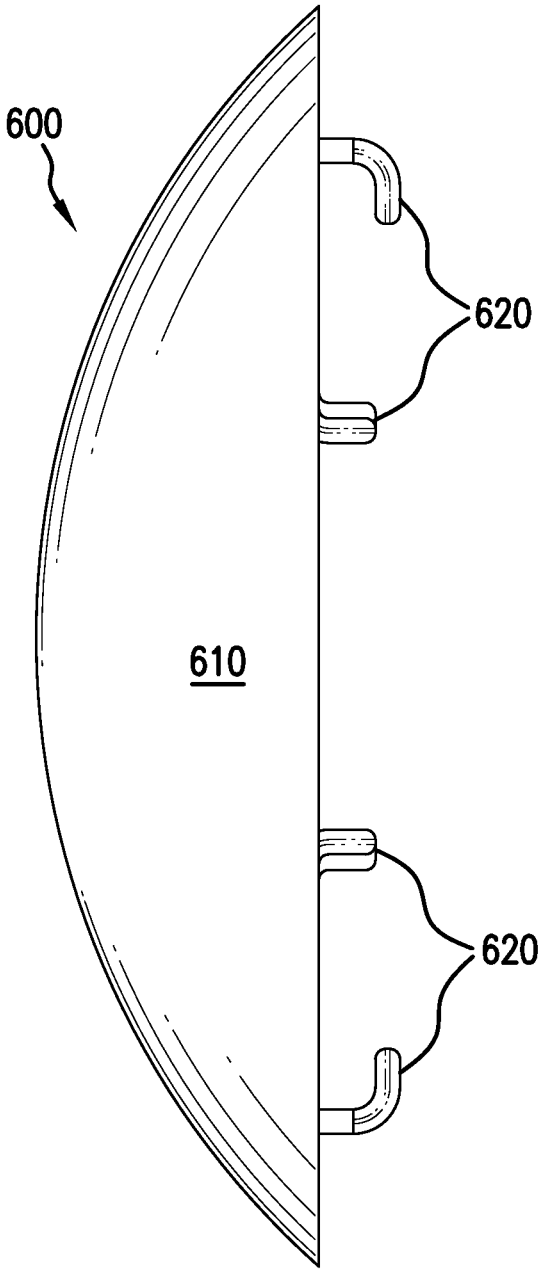
Figure 6C:
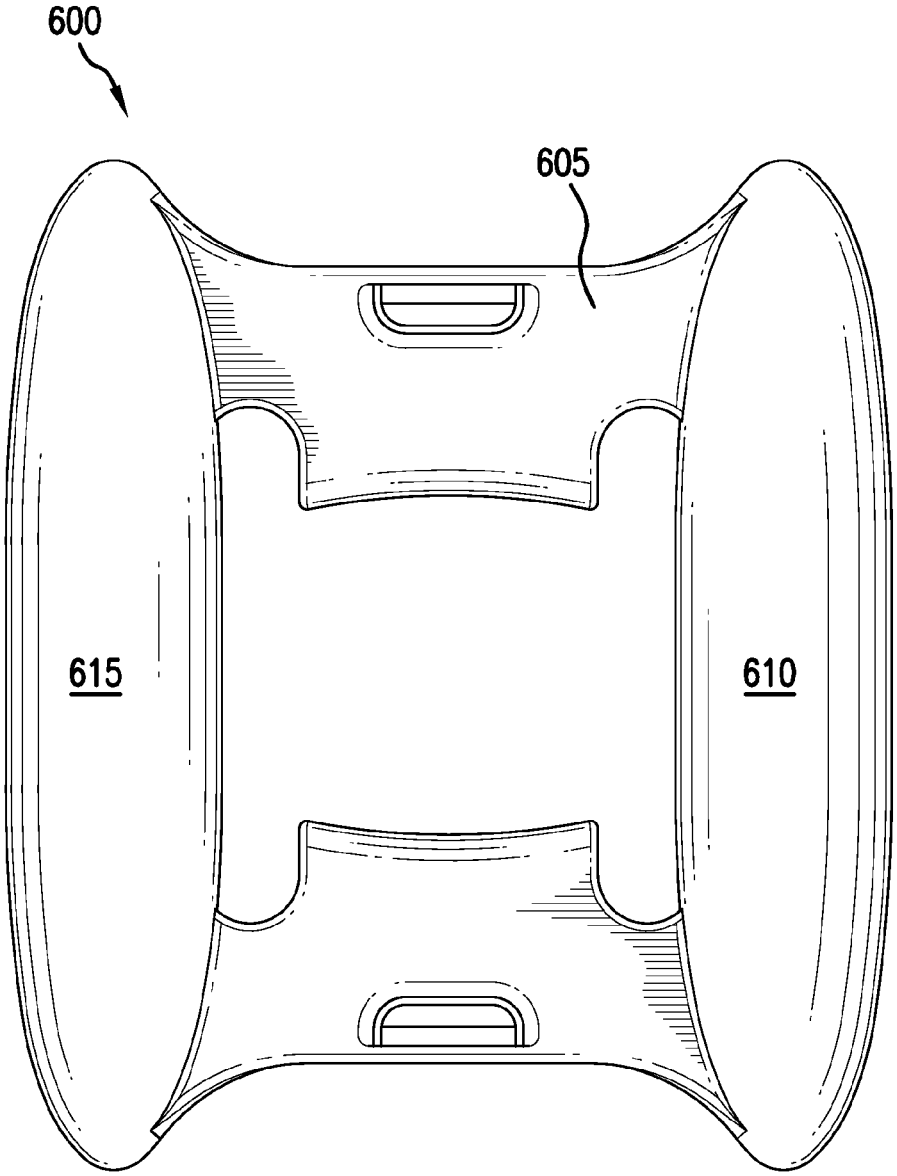

FIGS. 6A-6C depict a perspective view, a side elevation view and a plan view of an exemplary dorsal wear-pad, respectively. In the FIGS. 6A-6C embodiment, a dorsal wear-pad 600 is depicted. The dorsal wear-pad 600 shown has a base 605 and two projections 610, 615. Each depicted projection 610, 615 has a semi-ellipsoidal structure, in which an outwardly-facing surface of each projection has both a horizontal curvature and a vertical curvature. Projecting elevations of the projections 610, 615 relative to the base 605 may be larger than the projecting elevation of a D-ring 510 relative to the base 605. The dorsal wear-pad 600 may have attachment clips 620 which may facilitate attachment to a D-pad 540. In various embodiments, other means of attaching a dorsal wear-pad 600 may be used. For example, a dorsal wear-pad 600 may be riveted to a fall-protection safety harness 205. In some embodiments, a dorsal wear-pad 600 may be integrated into a D-pad 540, for example. In some embodiments, the dorsal wear-pad 600 may attach to a fall-protection safety harness 205 via webbing apertures in a dorsal wear-pad. Exemplary fall-protection safety harnesses may have a dorsal comfort pad or back pad proximate to the D-pad 540. A dorsal comfort pad may provide comfort to a wearer of a fall-protection safety harness 205. Exemplary back pads are described, for example, with reference to at least FIGS. 8-10 in U.S. patent application 61/712,243 titled "Fall Protection Harness Assembly," filed on Oct. 10, 2012, the entire disclosure of which is herein incorporated by reference.

Figure 7A:
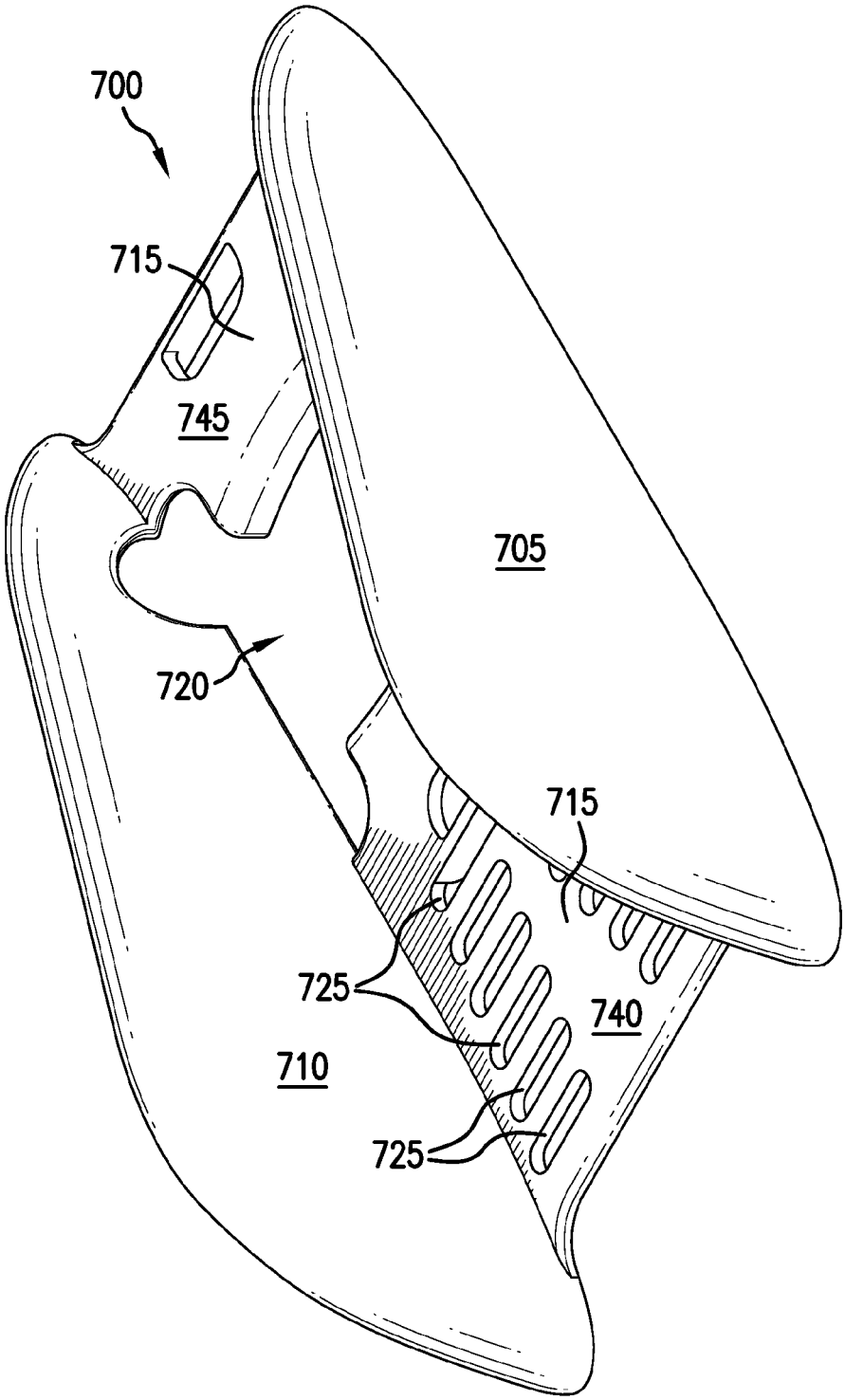
FIGS. 7A-7C depict a perspective view, a side elevation view and a plan view of an exemplary dorsal wear-pad, respectively.
Figure 7B:
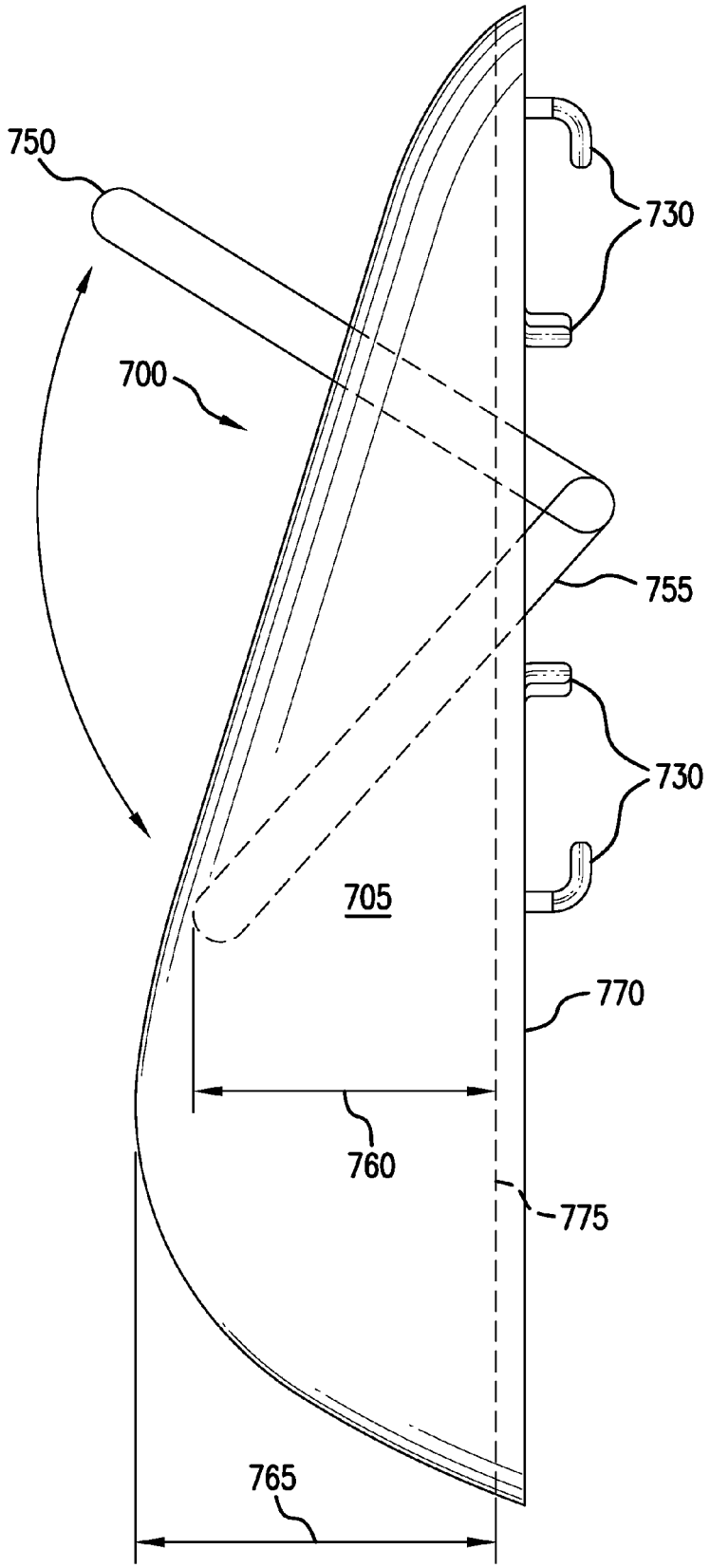
Figure 7C:
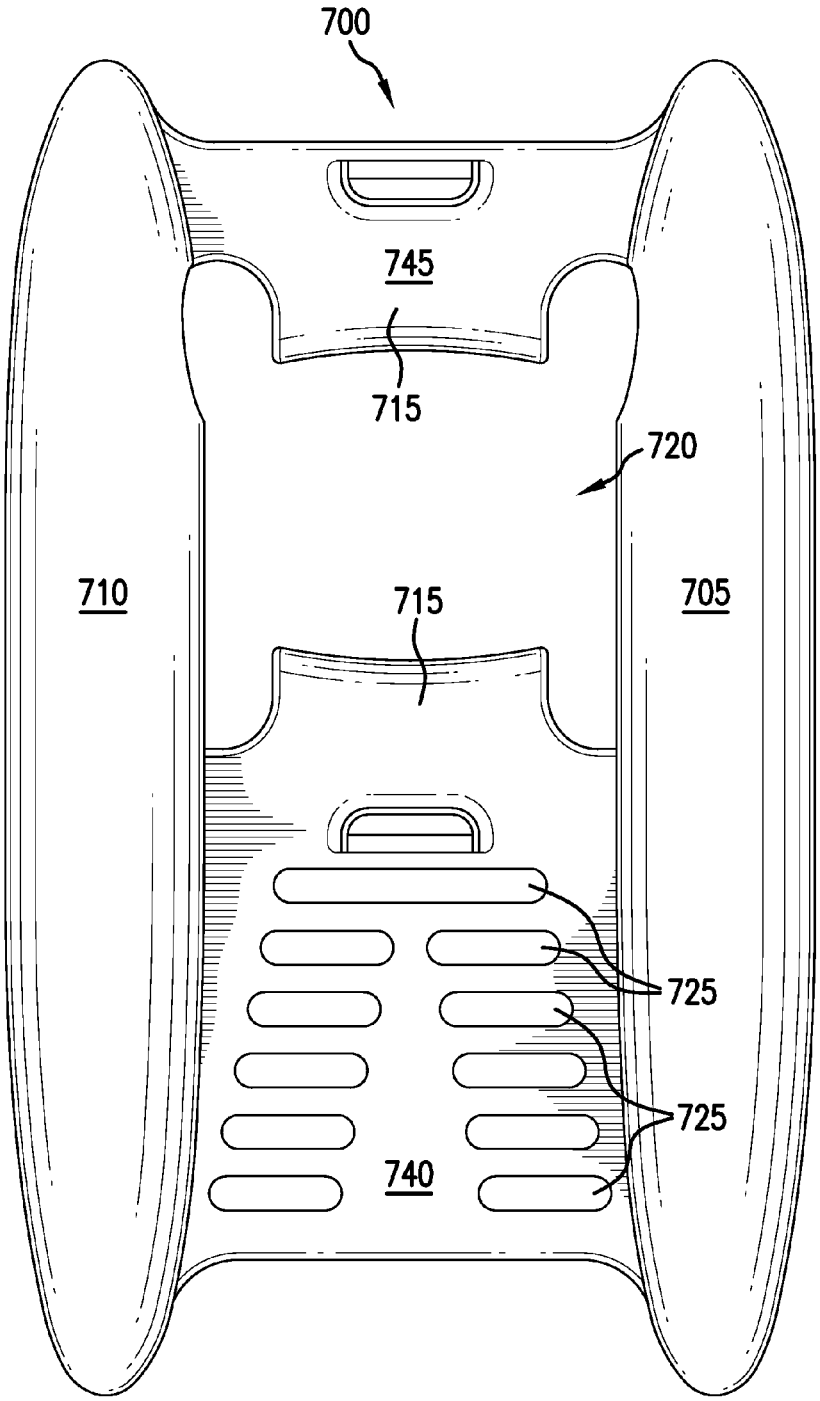

FIGS. 7A-7C depict a perspective view, a side elevation view and a plan view of an exemplary dorsal wear-pad, respectively. In the FIGS. 7A-7C embodiment, an exemplary dorsal wear-pad 700 is depicted. In this embodiment, the dorsal wear-pad 700 has two wear-bumps 705, 710. The two wear-bumps 705, 710 attach to a base plate 715. The base plate has a D-ring aperture 720 and a plurality of cooling apertures 725. The cooling apertures may provide airflow to the wearer of a fall-protection safety harness, for example. As in the FIGS. 6A-6C example, this embodiment has clips 730 for attachment to a D-pad 540. When worn, the FIG. 7C perspective depicts the orientation of the D-pad 540 as would be viewed from the back-side of a wearer. The base, 715 has a lower region 740 and an upper region 745. The lower region 740 extends below the D-ring aperture 720 when worn. The lower region 740 may act as a shield to protect the user from devices attached to and hanging from a D-ring 510. A snap-hook may be attached to the D-ring 510. The snap-hook may swing as the wearer of the fall-protection safety harness 205 moves. This movement may cause the snap-hook to repeated strike the wearer. In some embodiments, a snap-hook may have a gate-lever release knob which may dig into a wearer's back if no shield is present. Such repeated strikes can be unpleasant and/or painful. The wear-bumps 705, 710 have a vertical asymmetry as well. The projecting elevation of the wear-bumps 705, 710 relative to the base 715 are greatest at a vertical location below the D-ring aperture 720 when worn. The vertical locations at which the wear-bumps' projecting elevations are at their maximum may coincide with the vertical location of the distal end of a D-ring 510 in a downward-canted position. The wear-bumps' projecting elevations relative to the base may be greater than the projecting elevation of the distal end of a D-ring 510 in a downward-canted position relative to the base 715. The wear-bumps 705, 710 may then contact a wall surface before the D-ring 510 would contact that same surface.

FIG. 7B depicts an upwardly canted D-ring 750. The figure also depicts a downwardly canted D-ring 755. The D-ring may rotate from the upwardly canted position 750 to the downwardly canted position 755. The wear-bump 705 has an elevation 765 with respect to an outwardly facing surface 775 of a base plate. The figure also depicts an inwardly facing surface 770. When the D-ring is in the downwardly canted position 755, the D-ring has an elevation 760 relative to the outwardly facition surface 770 of the base plate. In this exemplary embodiment, the elevation 760 of the downwardly canted D-ring 755 is less than the elevation 765 of the wear-bump 705. The wear-bump 705 may make contact with a wall structure thereby preventing the downwardly canted D-ring 755 from making contact. The wear-bump elevation 765 may thereby protect the wall structure from damage. When the wear-bump 705 contacts a wall structure, the wear-bump 705 may deform which may provide a cushioning of the contact. A wearer of a dorsal wear-pad 700 may find more comfort in incidents involving contact with wall structures.

Figure 8A:
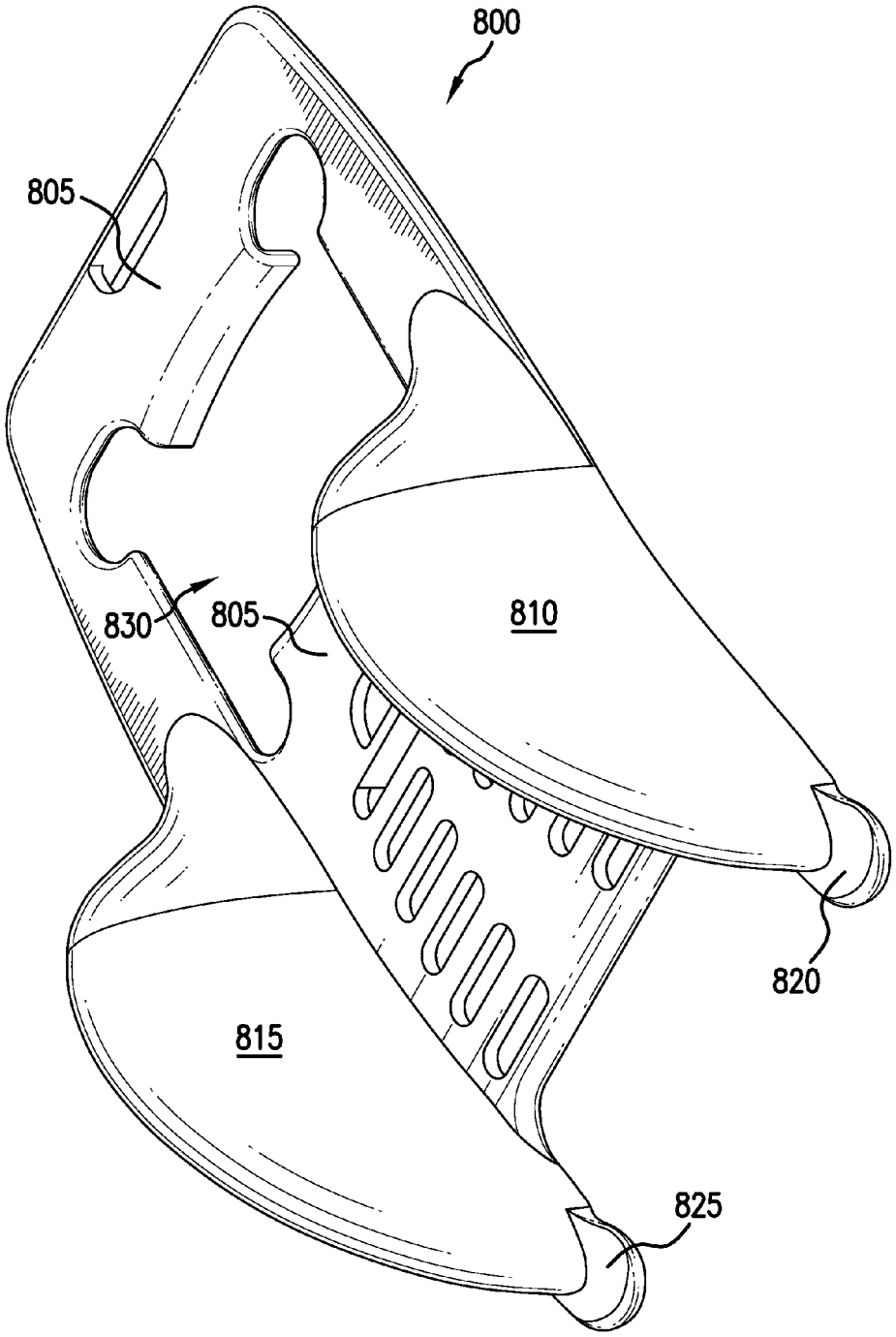
FIGS. 8A-8C depict a perspective view, a side elevation view and a plan view of an exemplary dorsal wear-pad, respectively.
Figure 8B:
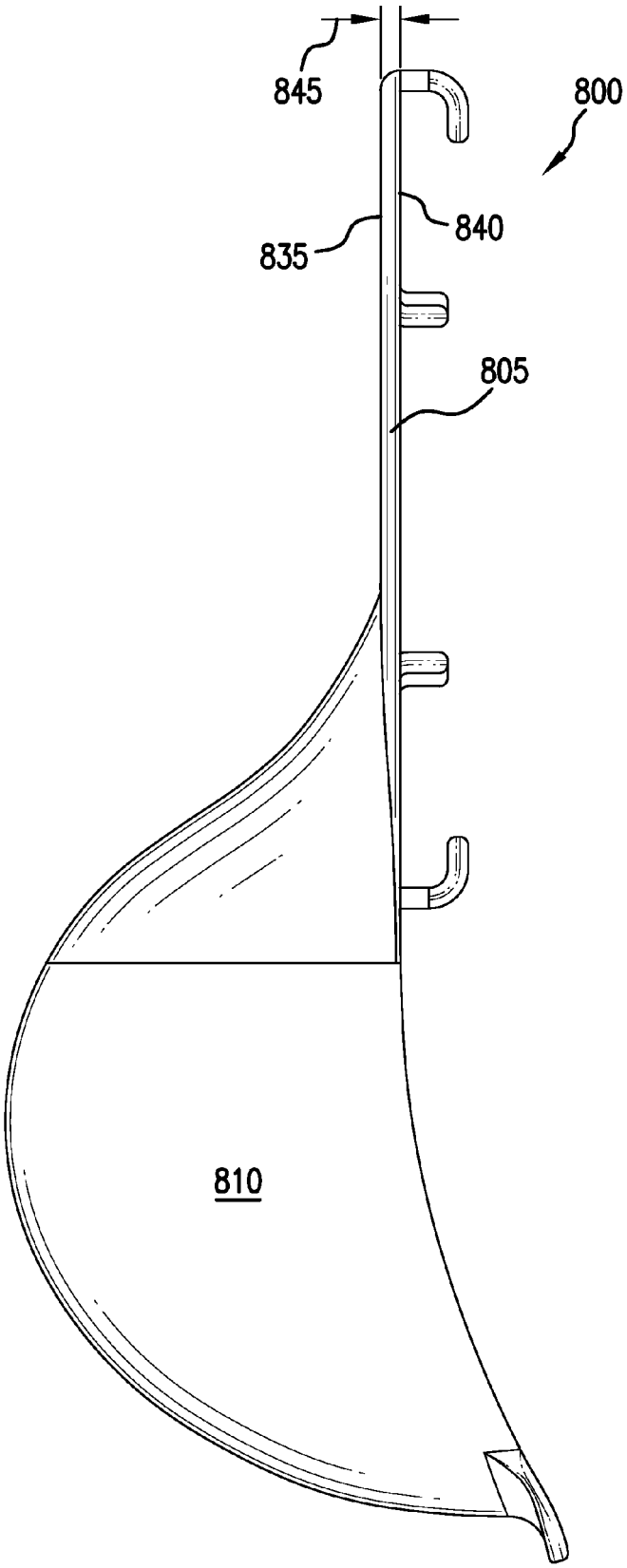
Figure 8C:
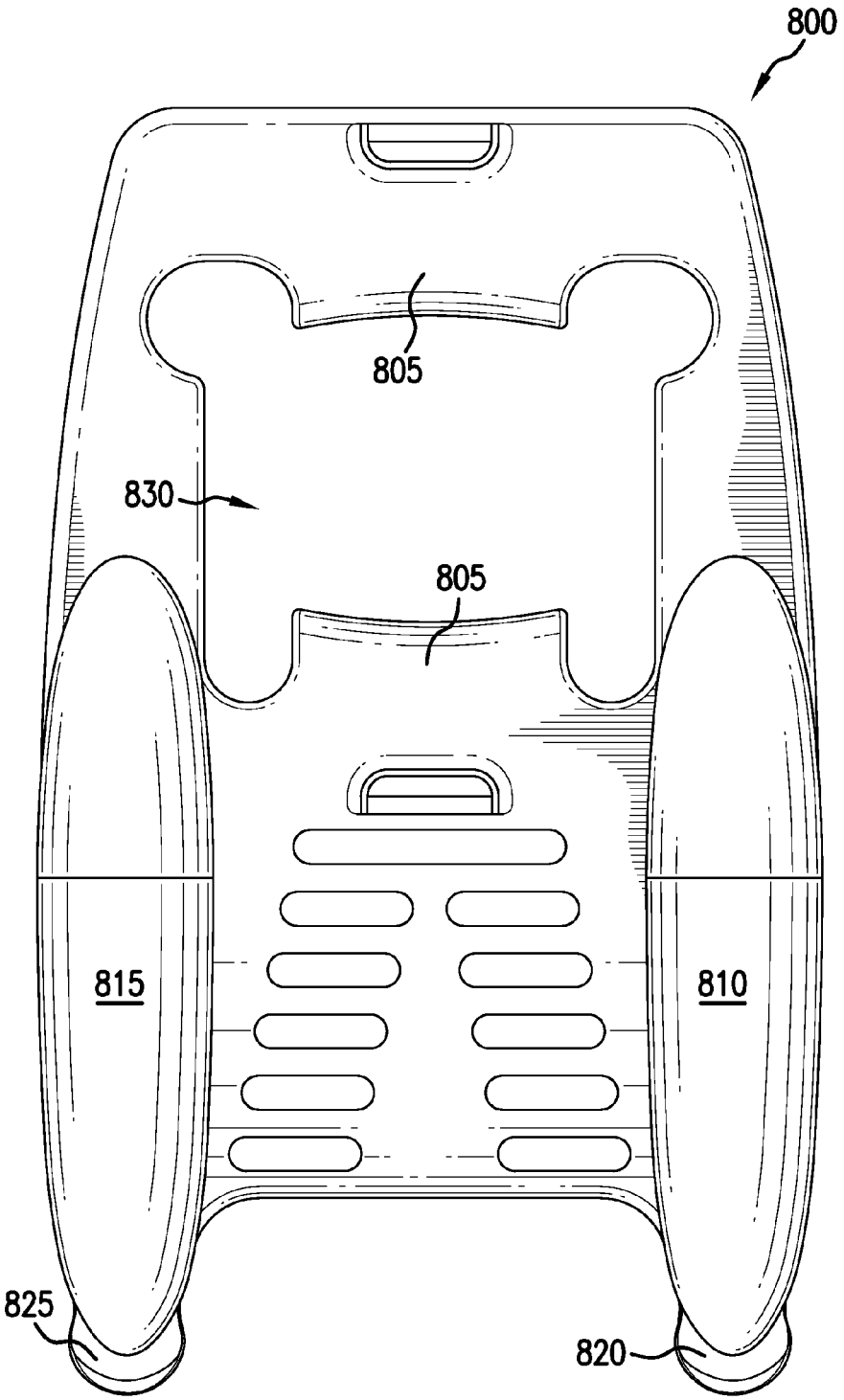

FIGS. 8A-8C depict a perspective view, a side elevation view and a plan view of an exemplary dorsal wear-pad, respectively. In the FIGS. 8A-8C embodiment, a dorsal wear-pad 800 includes a non-planar substrate 805. The non-planar substrate 805 may conform to a human body. In some embodiments, the non-planar substrate may have a curved presentation to the wearer's back so that the wearer is not exposed to a point or edge. The exemplary dorsal wear-pad shown has two wear-bumps 810, 815 projecting from the non-planar base 805. In this embodiment, the wear-bumps 810, 815 each have a tab 820, 825 respectively. The tabs 820, 825 may distribute a force at the tabs over a greater surface area than if the tabs 820, 825 were absent. In this embodiment, the wear-bumps 810, 815 are located substantially below a D-ring aperture 830 when worn.

In FIG. 8, the non-planar substrate 805 is shown to have an outwardly facing surface 835 when worn and an inwardly facing surface 840 when worn. The non-planar substrate 805 has a thickness 845, which may be substantially equal to a wall thickness of the wear-bumps 805, 810 in some embodiments.

Although various embodiments have been described with reference to the figures, other embodiments are possible. For example, various materials may be used to manufacture a lumbar wear-pad and/or a dorsal wear-pad. In some embodiments a high-density polyethylene may be used. Some embodiments may use another plastic. For example, ABS plastics may be used to make a dorsal wear-pad, for example. In some embodiments, the projections may be hollow. In some embodiments the projections may be solid. In some embodiments the projections may be filled. For example a foam material may be used to fill interior hollows of the projections. In various embodiments, different materials may be used for different members. For example, relatively rigid materials may be used for the attachment members of the dorsal wear-pad and/or the lumbar wear-pad. In some embodiments, more flexible materials may be used for the base and or wear-bumps. For example, the substrate of an exemplary lumbar wear-pad may be fairly flexible. In another example, the substrate of an exemplary dorsal wear-pad may be more rigid, so as to connect firmly with a D-pad. In some embodiments, one or more wheels may attach to the wear-bumps. Such wheels may very low-friction slidability with a wall. A caster wheel may be used which may provide omni-directional slidability, for example. Exemplary dorsal wear-pads may employ wheels in the wear-pad for similar purposes.

Various lumbar wear-pad embodiments may have different numbers of wear-bumps. For example, some embodiments may have an odd number of wear-bumps, with the center wear-bump proximate the wearer's spine when worn. Such an arrangement of wear-bumps may protect the spine from injury during a contact event with a wall. In some embodiments, a lumbar wear-pad may have an even number of wear-bumps with innermost wear-bumps straddling a wearer's spine. Such an arrangement may provide more comfort to some wearer's when the wearer makes contact with a wall.

In various embodiments, the wear-pads may have various geometries. In some embodiments, the wear-pads may have substantially different vertical and horizontal dimensions. In some geometries, the vertical dimensions may be greater than the horizontal dimensions. In some embodiments the horizontal dimensions may be greater than the vertical dimensions. In an exemplary embodiment, a lumbar wear-pad may have three projections whose vertical dimensions are greater than their horizontal dimensions, respectively, while a fourth projection has a horizontal dimension that is greater than its vertical dimension. Still other projections may have substantially equal vertical and horizontal dimensions. In one embodiment, a lumbar wear-pad may have a projection located proximate a wearer's tail bone. This projection may have a projecting height relative to a base plate that is less than the projecting height of other projections on the lumbar wear-pad, for example. An exemplary embodiment may have an elongated central projection on a lumbar wear-pad. This elongated central projection may extend below the other projections when worn. This elongated projection may extend to cover the tail-bone, for example.

Various embodiments may have a curvature of the base plate. Such curved base plates may provide for anatomical conformation of a wearer. For example, an exemplary dorsal wear-pad may have a curved base-plate which substantially conforms to a wearer's upper back. In some embodiments, a curved base-plate may substantially conform to the geometry of a fall-protection safety harness. An exemplary fall-protection safety harness may have different thicknesses of padding at different harness locations. An exemplary dorsal wear-pad and/or lumbar wear-pad may complementarily conform to the padding thickness variations, for example.

Various embodiments may have various connection mechanisms for connecting to a fall-protection safety harness or to a webbing. For example various D-pads may present different geometries for connection. Various dorsal wear-pads may have connectors which may be aligned to connect to these various D-pad geometries. Similarly, various lumbar wear-pads may have various connectors which may be aligned to connect to various harness types and/or harness models.

A variety of safety interface devices may be employed to connect a webbing of a fall-protection safety harness to other devices. A D-ring may be used in some embodiments. Exemplary dorsal wear-pads may have an aperture sized for a safety interface device to project therethrough. In some embodiments, the safety-interface-device aperture of a dorsal wear-pad may be configured to permit the safety interface device to rotate from an upward-canted position to a downward-canted position. Various exemplary safety interface devices are described, for example, with reference to at least FIGS. 2A-5B in U.S. patent application Ser. No. 12/659,885 titled "D-Ring with Rescue Attachment and Lanyard Attachments Integrated," filed on Sep. 5, 2012, the entire disclosure of which is herein incorporated by reference.

A variety of safety lanyard connectors may be employed to connect a lanyard to a safety interface device. In some embodiments a snap-hook may connect to a safety interface device, for example. In some embodiments a carabiner may connect a lanyard to safety interface device. A rescue hook may be used in conjunction with a safety interface device, for example.

When a wearer of a lumbar wear-pad engages a vertical wall, the lumbar wear-pad may flexibly conform to the wearer's body. In some embodiments, the lumbar wear-pad may flex, so as to permit the engagement of two or more of the wear-bumps. The engagement of multiple wear-bumps may distribute the load over multiple wear-bumps. An individual wear-bump that is engaged with a wall may itself flexibly deform to distribute the load across the bump. In various embodiments, a dorsal wear-pad may likewise flexibly conform to the wearer's body. In some embodiments, the dorsal wear-pad may flex, so as to permit the engagement of two of the wear-bumps. The engagement of multiple wear-bumps may distribute the load over multiple wear-bumps. An individual wear-bump that is engaged with a wall may itself flexibly deform to distribute the load across the bump.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A fall-protection safety harness for promoting slidable engagement between a wearer and a wall, the fall-protection safety harness comprising:

a webbing configured to be worn around a waist of the wearer; and a unitary-body lumbar wear-pad comprising high-density polyethylene replaceably coupled to the webbing and covering a length of the webbing at the lumbar region of a wearer's back, the lumbar wear-pad comprising:

a flexible substantially-planar base having an inside surface which inwardly faces the wearer when worn and an outside surface which outwardly faces away from the wearer when worn, the substantially-planar base comprising a plurality of cooling apertures extending through the substantially-planar base from the outside surface to the inside surface; and three semi-ellipsoidal raised wear-bumps, a first, a second, and a third, projecting outwardly from the outside surface of the substantially-planar base, each of the three wear-bumps having a major dimension along a vertical major axis, a minor dimension along a horizontal minor axis, and a projecting height relative to the outside surface, wherein the major dimension of each wear-bump is substantially greater than the minor dimension, the three wear-bumps aligned horizontally such that each of the three minor axes share a common horizontal centerline, the second wear-bump located substantially half-way between the first and the third wear-bumps, wherein the first and third wear-bumps have substantially equal major dimensions, substantially equal minor dimensions and substantially equal projecting heights, respectively, wherein the projecting height of the second wear-bump is less than either one of the projecting heights of the first and third wear-bumps, wherein each of the first, second and third wear-bumps has a belt aperture aligned to the centerline and configured to receive a belt proximate to the outside surface of the flexible planar base, the belt to pass horizontally through the three wear-bumps without requiring the belt to bend or twist.

2. The fall-protection safety harness of claim 1, further comprising a lumbar comfort pad proximate to the inside surface of the lumbar wear-pad.

3. The fall-protection safety harness of claim 1, further comprising the belt.

4. The fall-protection safety harness of claim 1, wherein the lumbar wear-pad further comprises webbing attachment clips configured to attach to a horizontal length of webbing.

5. A lumbar wear-pad configured to be replaceably coupled to a belted webbing, to cover a length of the belted webbing at a lumbar region of a wearer's back, and to provide for slidable engagement between a wearer and a wall surface, the lumbar wear-pad comprising:

a flexible substantially-planar base having an inwardly-facing surface which inwardly faces the wearer when worn and an outwardly-facing surface which outwardly faces away from the wearer when worn; and a plurality of raised wear-bumps, projecting outwardly from the outwardly-facing surface, each of the wear-bumps having a major dimension along a major axis, a minor dimension along a minor axis, and a projecting height relative to the outwardly-facing surface, wherein each of the plurality of raised wear-bumps further comprises a belt aperture configured to receive a belt proximate to the outwardly-facing surface of the flexible planar base, the belt to pass horizontally through the plurality of wear-bumps without requiring the belt to bend or twist, wherein the plurality of wear-bumps comprise one or more inner wear-bumps and two outer wear-bumps of a horizontal configuration when worn, wherein the wear bumps are located on the outwardly-facing surface of the planar base, and the inner wear bumps are disposed between the two outer wear bumps, wherein the horizontal configuration comprises an arrangement of wear-bumps with a horizontal mirror symmetry about a center of the lumbar wear-pad, wherein a horizontal line traverses each wear-bump.

6. The lumbar wear-pad of claim 5, wherein the projecting height of each of the inner wear-bumps is less than the projecting height of each of the outer wear-bumps.

7. The lumbar wear-pad of claim 5, wherein each of the plurality of raised wear-bumps has a curved outwardly-facing surface at a contact region which comprises a region wherein the projecting height is greater than a projecting height of a non-contact region.

8. The lumbar wear-pad of claim 5, wherein the substantially-planar base further comprises a plurality of cooling apertures extending through the substantially-planar base from the outwardly-facing surface to the inwardly-facing surface.

9. The lumbar wear-pad of claim 5, wherein substantially-planar base is coupled to each of the plurality of raised wear-bumps.

10. The lumbar wear-pad of claim 5, wherein the one or more inner wear-bumps comprises an odd number of inner wear-bumps.

11. The lumbar wear-pad of claim 5, wherein the one or more inner wear-bumps comprises an even number of inner wear-bumps.

12. The lumbar wear-pad harness of claim 5, wherein the lumbar wear-pad further comprises webbing attachment clips configured to attach to a horizontal length of webbing.

13. A lumbar wear-pad configured to be replaceably coupled to a belted webbing, to cover a length of the belted webbing at a lumbar region of a wearer's back, and to provide for slidable engagement between a wearer and a wall surface, the lumbar wear-pad comprising:

a flexible substantially-planar base having an inwardly-facing surface which inwardly faces the wearer when worn and an outwardly-facing surface which outwardly faces away from the wearer when worn; and a plurality of raised wear-bumps, projecting outwardly from the outwardly-facing surface, each of the wear-bumps having a major dimension along a major axis, a minor dimension along a minor axis, and a projecting height relative to the outwardly-facing surface, and means for attaching the lumbar wear-pad to a fall-protection safety harness, wherein each of the plurality of raised wear-bumps further comprises a belt aperture configured to receive a belt proximate to the outwardly-facing surface of the flexible planar base, the belt to pass horizontally through the plurality of wear-bumps without requiring the belt to bend or twist, wherein the plurality of wear-bumps comprise one or more inner wear-bumps and two outer wear-bumps of a horizontal configuration when worn, wherein the wear bumps are located on the outwardly-facing surface of the planar base, and the inner wear bumps are disposed between the two outer wear bumps, wherein the horizontal configuration comprises an arrangement of wear-bumps with a horizontal mirror symmetry about a center of the lumbar wear-pad, wherein a horizontal line traverses each wear-bump.

14. The lumbar wear-pad of claim 13, wherein the means for attaching the lumbar wear-pad to a fall-protection safety harness comprises webbing attachment clips configured to attach to a horizontal length of webbing.

15. The lumbar wear-pad of claim 13, wherein the means for attaching the lumbar wear-pad to a fall-protection safety harness comprises rivets.

16. The lumbar wear-pad of claim 13, wherein the projecting height of each of the inner wear-bumps is less than the projecting height of each of the outer wear-bumps.

* * * * *